US005253888A

United States Patent [19]

Friedrich

[11] Patent Number: 5,253,888

[45] Date of Patent: Oct. 19, 1993

[54] RIGID FRAME WELDLESS WHEELCHAIR

[75] Inventor: Paul Friedrich, Ventura, Calif.

[73] Assignee: Da International, Ltd., White Plains, N.Y.

[21] Appl. No.: 35,691

[22] Filed: Apr. 2, 1993

[51] Int. Cl.[5] ..... A61G 5/02

[52] U.S. Cl. ..... 280/250.1; 280/304.1

[58] Field of Search ..... 280/250.1, 281.1, 287, 280/304.1; 403/34, 373, 388, DIG. 9, 110

[56] References Cited

U.S. PATENT DOCUMENTS

| | | | |
|---|---|---|---|
| 3,216,752 | 11/1965 | Rifken | 403/217 |
| 3,228,716 | 1/1966 | Parkin | 403/217 |
| 3,360,287 | 12/1967 | Wyse | 403/217 |
| 3,423,113 | 1/1969 | Gonsalves | 403/217 |
| 4,039,263 | 8/1977 | Bassler | 403/218 |
| 4,484,832 | 11/1984 | Weissenberger | 403/191 |
| 4,500,102 | 2/1985 | Haury et al. | 280/304.1 |
| 4,515,497 | 5/1985 | Gillemot et al. | 403/391 |
| 4,570,756 | 2/1986 | Minnebraker et al. | 280/304.1 X |
| 4,679,816 | 7/1987 | Riikonen | 280/250.1 X |
| 4,702,638 | 10/1987 | Zalesak | 403/403 |
| 4,721,321 | 1/1988 | Haury et al. | 280/250.1 |
| 4,754,506 | 7/1988 | Yeh | 5/53.1 |
| 4,784,511 | 11/1988 | Greene | 403/169 |
| 4,811,964 | 3/1989 | Horn | 280/250.1 |
| 4,840,390 | 6/1989 | Lockard et al. | 280/250.1 |
| 4,981,305 | 1/1991 | Lockard et al. | 280/250.1 |
| 5,011,175 | 4/1991 | Nicholson et al. | 280/304.1 |

FOREIGN PATENT DOCUMENTS

| | | | |
|---|---|---|---|
| 0510502 | 12/1920 | France | 403/373 |
| 8702887 | 5/1987 | World Int. Prop. O. | 280/250.1 |

*Primary Examiner*—Margaret A. Focarino
*Assistant Examiner*—Victor E. Johnson
*Attorney, Agent, or Firm*—Lackenbach, Siegel, Marzullo, Aronson & Greenspan

[57] ABSTRACT

A wheelchair assembly which can be quickly and inexpensively assembled and disassembled is described which is formed of tubular members which are secured only with clamping members to produce a rigid frame wheelchair. No welds are utilized, the clamps being formed of molded composite material, such as a carbon fiber-filled polyamide. Each clamp is formed of complimentary shells formed with semi-cylindrical regions dimensioned to receive, between two mating complimentary members, cross tubes to be secured in pressure fit relationship.

18 Claims, 12 Drawing Sheets

RIGID FRAME WELDLESS WHEELCHAIR

BACKGROUND OF THE INVENTION

1. Field of the Invention

This invention generally relates to self-propelled vehicles, and more particularly, to a light-weight rigid frame wheelchair that does not utilize any weld joints but all of the structural elements are joined together only with pressure clamps.

2. Description of the Prior Art

Wheelchairs, used to transport those that are mobility impaired, have been available since the turn of the century. The first wheelchairs were bulky, heavy and extremely difficult to maneuver.

In 1932 the first tubular steel forming frame wheelchair was introduced by harry Jennings which was considerably lighter and easier to maneuver. It necessarily used folding mechanisms consisting of movable joints, linkages, etc. to connect the side frames of the chair.

Today's lifestyle is significantly more dynamic in every population segment including the disabled. This has prompted a wide market demand for a lighter, more durable, maneuverable and compact (when folded or disassembled) chair to allow for transportability in today's smaller cars. To satisfy the newly created market demand, in the late 1970s a conceptually new wheelchair with a rigid frame design was introduced.

The rigid frame wheelchair's side frames are secured to each other by rigid elements (tubes, bars, etc.) by means of welding. The absence of the folding mechanism in a rigid wheelchair provides the following advantages:

- increased strength and durability (less moving parts)
- increased energy efficiency (folding mechanism absorbs energy needed to propel the chair)
- decreased weight (less parts)
- increased maneuverability
- increased stability
- increased comfort Unfortunately, the existing welded rigid frame design chairs are prohibitively expensive due to high cost of manufacturing.

Examples of such wheelchairs that utilize welded joints are disclosed in U.S. Pat. Nos. 4,840,390 and 4,981,305 issued to Lockard et al. In Lockard, identical side frames are made up of a pair of generally L-shaped tubular numbers that are welded together. A sports wheelchair is disclosed in U.S. Pat. No. 4,500,102 issued to Haury et al that includes a one piece, welded tubular frame assembly. Another U.S. Pat. No. 4,721,321 issued to Haury et al discloses a similar sports wheelchair construction. Another welded wheelchair frame is disclosed in U.S. Pat. No. 4,811,964 issued to Horn for a wheelchair propelled by rowing.

A folding frame wheelchair that is movable between an upper normal sitting position and a lower reclining position that does not utilize welds is disclosed in U.S. Pat. No. 5,011,175 issued to Nicholson et al. However, such chair is a folding frame wheelchair. While it includes no welds, it is secured together by means of pivoted members or linkages that render the chair construction less stable and less secure. The chair has all the disadvantages of folding frame wheelchairs.

Also known are numerous clamping element designs for securing two or more tubular members to each other. By way of example only, reference is made to U.S. Pat. No. 4,515,497 issued to Gillemot et al for a clamping element for releasable fastening of spatially arranged, or parallel bars, tubes and similar objects; U.S. Pat. No. 4,039,263 issued to Bassler for a connector joint; U.S. Pat. No. 4,695,179 to Schnell for a fastening arrangement for a minimum of three struts along the spatial axes; U.S. Pat. No. 4,294,561 to Chapman et al for a jointing member for frame systems; U.S. Pat. Nos. 4,597,140 and 4,597,690 issued to Girard for tube clamps; U.S. Pat. No. 3,423,113 issued to Gonsalves et al for a connection for tubular members; U.S. Pat. No. 4,784,511 issued to Greene for a connector for tubular frame members; and U.S. Pat. No. 3,216,752 issued to Rifken for coupling means for building frameworks, racks, scaffolds and the like. In U.S. Pat. No. 4,702,638 issued to Zalesak, inexpensive, knock-down furniture assembled with mating, molded, plastic shells for corners and elbows is disclosed.

Notwithstanding the fact that numerous clamps have been proposed for securing tubular members to each other, the wheelchair industry has continued to rely on welded frame constructions for rigid wheelchairs. However, the welding/brazing operation proved to be *inconsistent, hazardous, time consuming and expensive.* It results in metal fatigue due to crystallization/oxidation, creates a heat-effected zone next to the weld which could lead to a potential safety hazard (i.e. collapse of the chair). It also requires additional operations such as polishing/grinding, electrochemical plating, etc., all of which are hazardous to both workers and environment.

All of the above processes would have to be repeated in the case of an accidental failure of the chair (i.e. weld breakage), which would entail a prohibitively high repair cost.

SUMMARY OF THE INVENTION

It is, therefore, a primary object of the invention to provide a rigid frame wheelchair construction that does not utilize any welded joints.

It is another object of the present invention to provide a wheelchair construction of the type aforementioned that relies only on pressure clamps for securing the tubular members that form the frame of the wheelchair.

It is still another object of the present invention to provide a wheelchair as in the above objects, that provides a rigid frame wheelchair of superior strength and durability that can be used under all adverse conditions.

It is yet another object of the present invention to provide a rigid frame wheelchair as suggested in the previous objects that is of reduced weight for easy maneuverability and transportability.

It is a further object of the present invention to provide a wheelchair having a rigid frame construction that uses pressure clamps in place of welded joints to facilitate and substantially reduce the manufacturing costs, making it possible for such wheelchairs to be more affordable.

It is a further object of the present invention to provide a rigid frame wheelchair design achieved through an environmentally safe and hazard-free manufacturing process.

It is a further object of the present invention to provide a wheelchair having a rigid frame construction that uses pressure clamps in place of welded joints to facilitate consistent durability and safety of the wheelchair.

It is yet another object of the present invention to provide a rigid frame wheelchair as suggested in the previous objects for which even in the highly unlikely case of accidental failure the safety hazard is minimal and the repair cost (clamp replacement) is easy, quick, inexpensive, and can be performed by a non-professional.

It is yet a further object of the present invention to provide a rigid frame wheelchair construction as described in the previous objects that is lighter and more compact when folded or disassembled to allow for easy transportability and storage.

In order to achieve the above objects, as well as others which will become apparent hereafter, a wheelchair in accordance with the present invention comprises a pair of like side frame assemblies spaced from each other and each including a generally horizontal seat tube, a generally horizontal bottom tube below said seat tube, each of said seat and bottom tubes having front and rear ends; and a generally vertical backrest tube having a lower end proximate to said rear ends of said seat and bottom tubes and an upper end extending upwardly of said seat tube and forming hand grips. A caster assembly is provided carrying caster wheels associated with a side frame assembly and having a generally upwardly extending shaft portion. First clamping means are provided for rigidly clamping said rear ends of said seat and bottom tubes and said lower end of said backrest tubes. Second clamping means are provided for rigidly clamping said front ends of said seat and bottom tubes and caster assembly bottom portion. Foot rest support means are provided secured to said seat rest tube. Transverse tube means extend between said side frame assemblies and have lengths substantially corresponding to the width of the wheelchair. Third clamping means are provided for rigidly connecting each transverse tube means to said side frame assemblies. A wheel axle extends between said second clamping means associated with each of said frame assemblies. Rear wheels are mounted on said rear axle.

The wheelchair is designed so that the majority of the components are prefabricated to minimize manufacturing or production time as well as eliminating numerous previously used processes such as chrome plating, brazing, welding, etc. that can be extremely hazardous both to the environment and to the workers involved.

BRIEF DESCRIPTION OF THE DRAWINGS

The benefits of the construction herein disclosed will become apparent to those skilled in the art from the following detailed description of a presently preferred embodiment, having reference to accompanying drawings wherein.

DESCRIPTION OF THE PREFERRED EMBODIMENT

Figure 1:
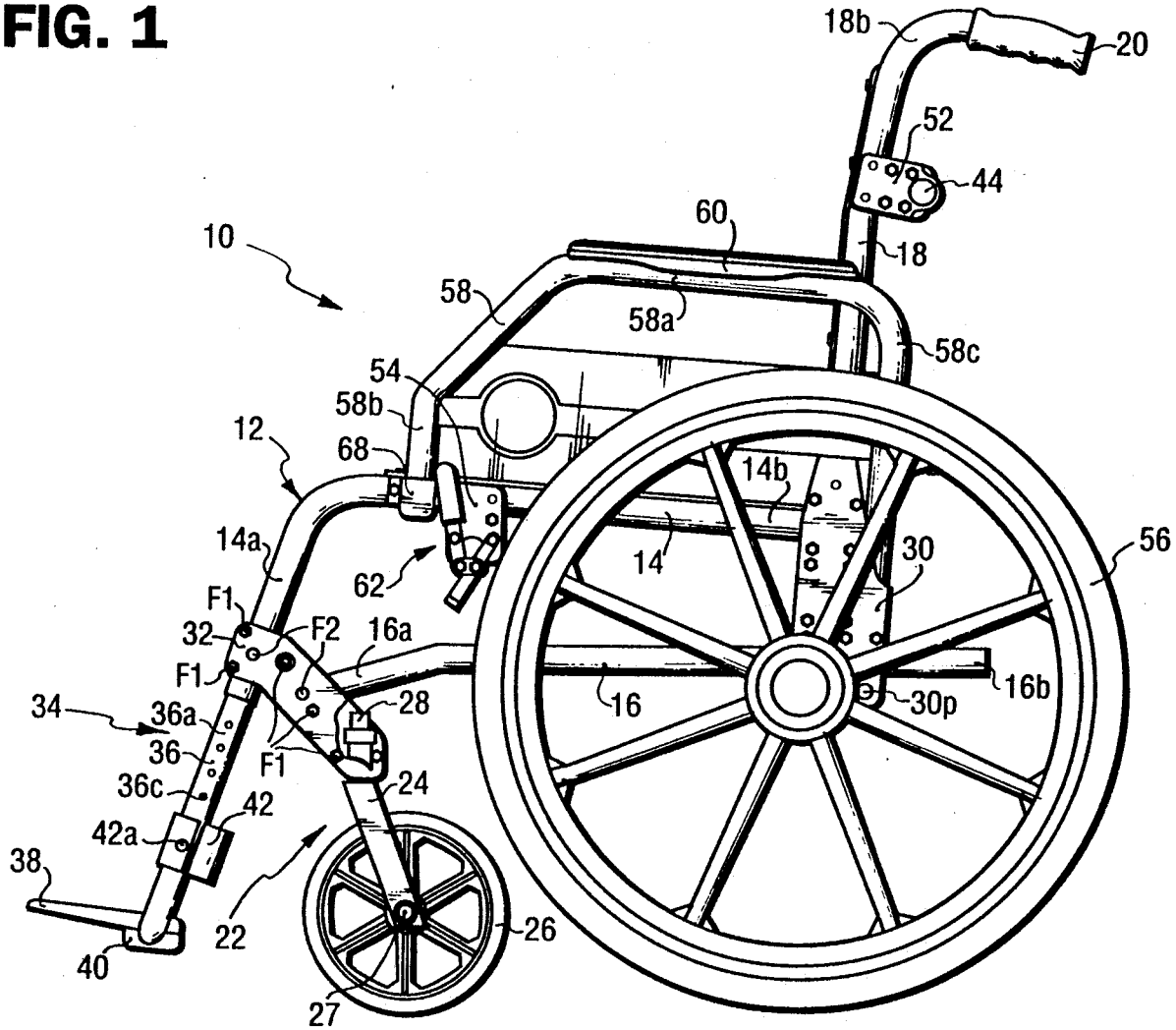
FIG. 1 is a side elevational view of a rigid wheelchair in accordance with the present invention.
Figure 2:
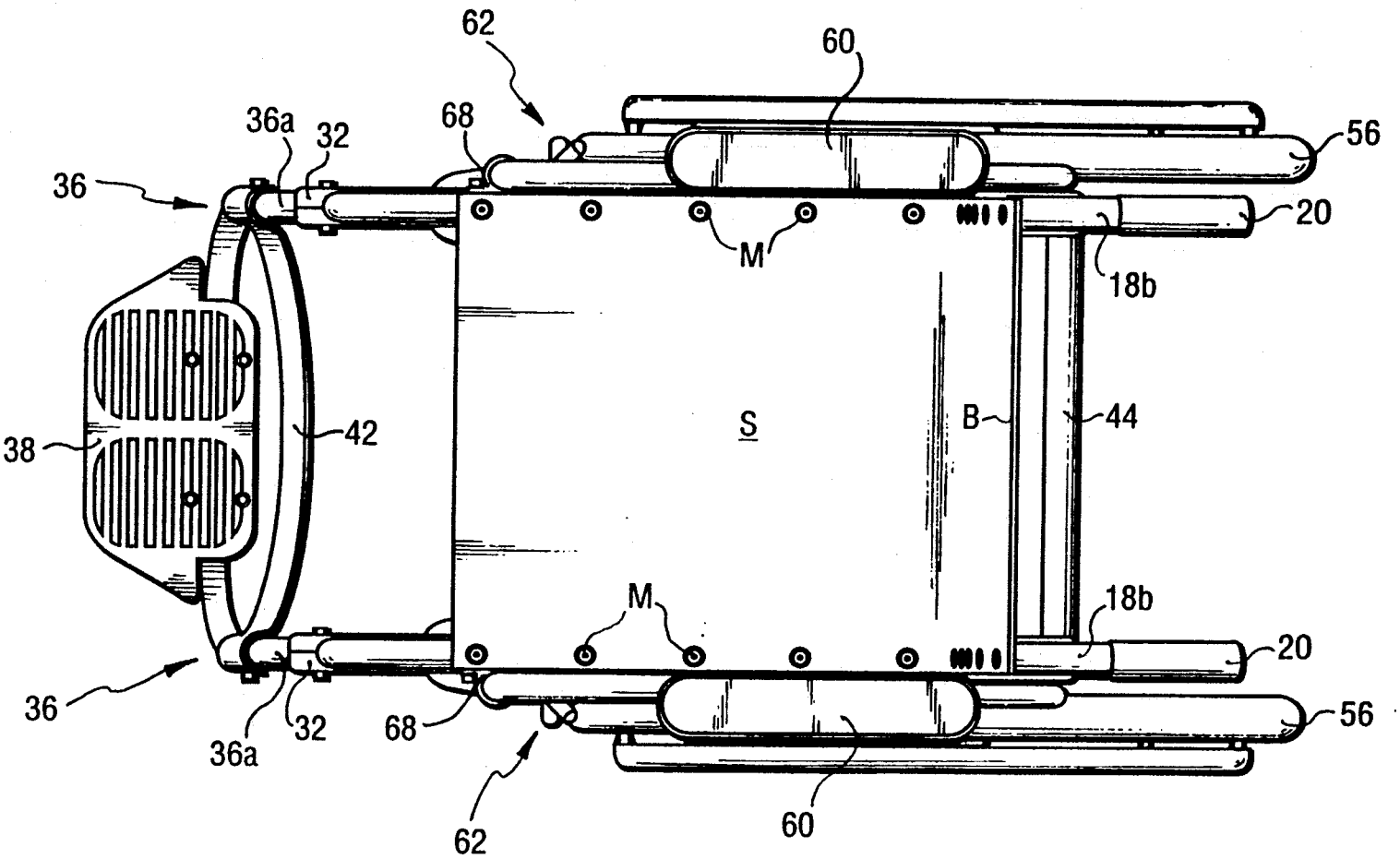
FIG. 2 is top plan view of the wheelchair shown in FIG. 1.
Figure 3:
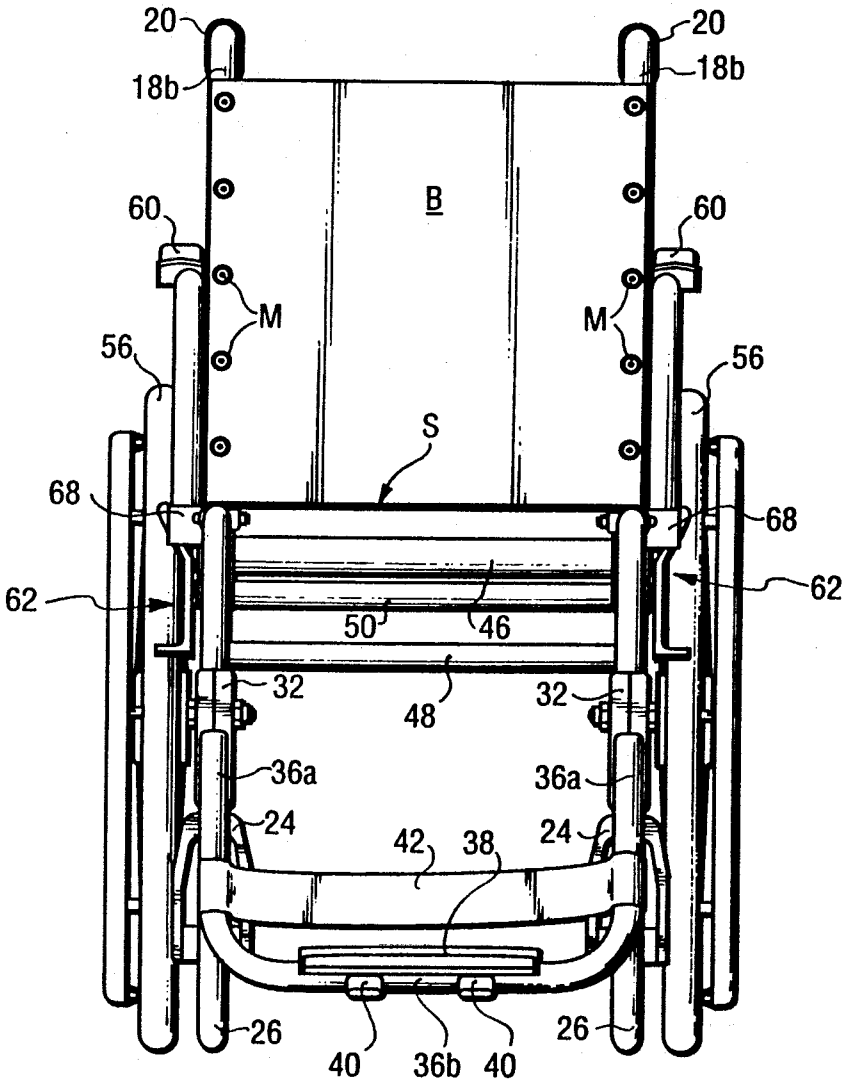
FIG. 3 is a front elevational view of the wheelchair shown in FIGS. 1 and 2.

Referring now specifically to the Figures, in which identical or similar parts are designated by the same reference numerals throughout, and first referring to FIGS. 1–3, a rigid frame weldless wheelchair in accordance with the present invention is generally not designated by the reference numeral 10.

Figure 14:
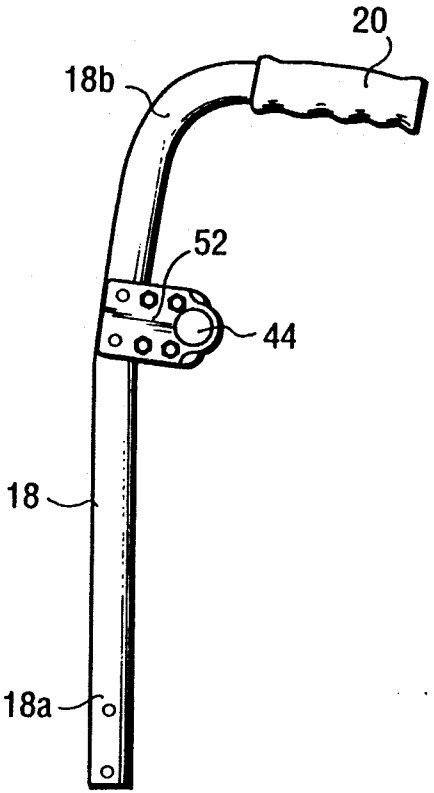
FIG. 14 is a side elevational view of the back parts shown in FIG. 13.
Figure 13:
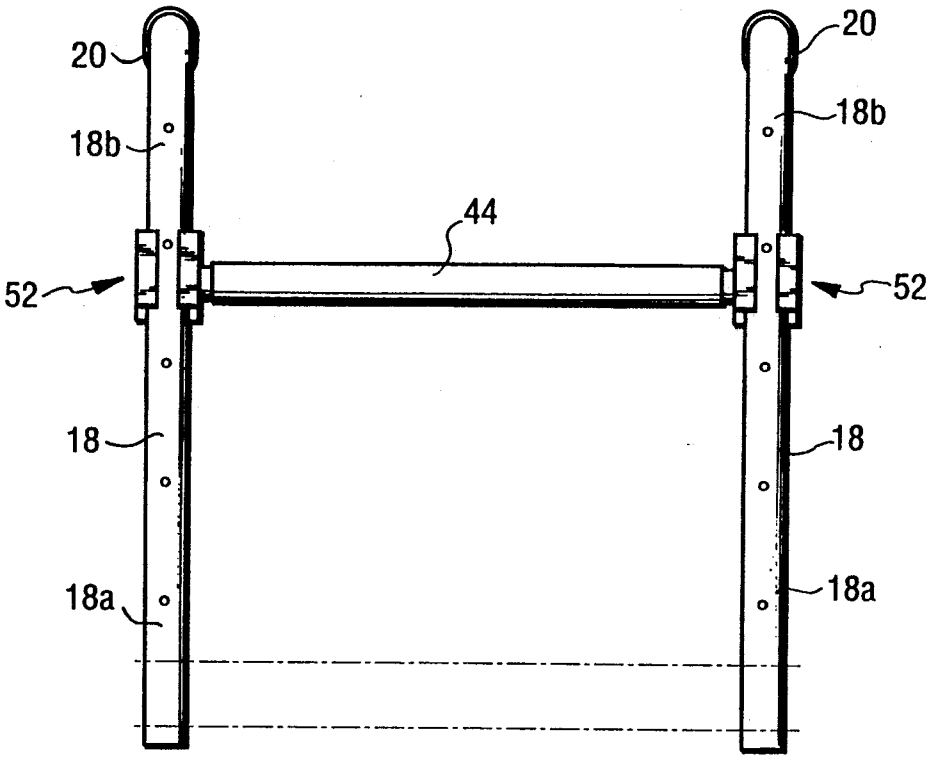
FIG. 13 is a front elevational view of the back posts and handle grips of the wheelchair secured to each other by a cross tube.

The chair 10 has a pair of like side frame assemblies 12 spaced from each other and each including a generally horizontal seat tube 14 and a generally horizontal bottom tube 16 below the seat tube. The seat and bottom tubes have front or proximal ends **14*a*, 16*a* and rear or distal ends 14*b*, 16*b*. A generally vertical back tube 18 is associated with each side frame assembly 12 and has a lower end 18*a* (FIGS. 13 and 14) proximate to the rear end of the seat tube 14 and bottom tube 16. The vertical backrest tube 18 has an upper end 18*b* extending upwardly of the seat tube 16, the extreme end of which is bent approximately 90° to form hand grips 20**.

A caster assembly is generally designated by the reference numeral 22 and includes a downwardly extending open fork member 24 that receives and supports a caster wheel 26 by means of a transverse axle 27. Extending upwardly from the fork member 24 is a solid shaft portion 28 rotatably supported about its axis in bearings, as will be described below.

A rear clamp assembly 30 is rigidly clamped to the rear ends **14*b*, 16*b* of the seat and bottom tubes 14, 16, respectively, and the lower end 18*a* of the backrest tube 18. Second, caster plate clamps 32 rigidly clamp the front ends 14*a*, 16*a* of the seat tubes 14 and bottom tube 16, respectively, and the caster assembly upwardly extending shaft portion 28**.

A footrest assembly 34 includes a generally U-shaped tube 36 (FIG. 3), the upper free ends 36*a* of which are telescopically received within the front ends 14*a* of the seat tubes 14, as shown. A footrest 38 is secured to the lower transverse lower portion 36*b* (FIGS. 2 and 3) of the footrest tube 36 by means of footrest clamps 40. A belt or strap 42 extends between opposing legs of the footrest tube 36 and is positioned above the footrest 38 to serve as a foot support and to prevent the legs from slipping rearwardly off of the footrest. Any conventional fasteners 42*a* engageable through holes 36*c* in tube ends 36*a* may be used.

Four transverse cross tubes 44, 46, 48 and 50 extend from one side frame assembly 12 to the other and effectively determine the width of the wheelchair. The transverse cross tubes are rigidly secured by the rear clamping assembly 30 and clamps 52 and 54, to be more fully described.

A shaft (not shown) extends between opposing rear clamp assemblies 30 on which rear wheels 56 are rotatably mounted. Armrests 60 are mounted on the generally horizontal portion 58*a* of the armrest tubes 58. A rear wheel lock 62 is mounted on the tube clamp 54 which is positioned along the seat tube 14 proximate to the periphery of the rear wheel 56.

All of the tubular members of the wheelchair 10 are, therefore, rigidly secured to each other by means of two rear clamping assemblies 30, one on each side frame assembly 12, two caster plate clamps 32 and two pairs of cross tube clamps or retainers 52, 54. An important feature of the present invention is that the aforementioned clamps and retainer assemblies be inexpensive and reliable components that secure the designated tubular members to each other over long periods of time and which are inexpensive to manufacture and easy and quick to assemble.

Figure 4:
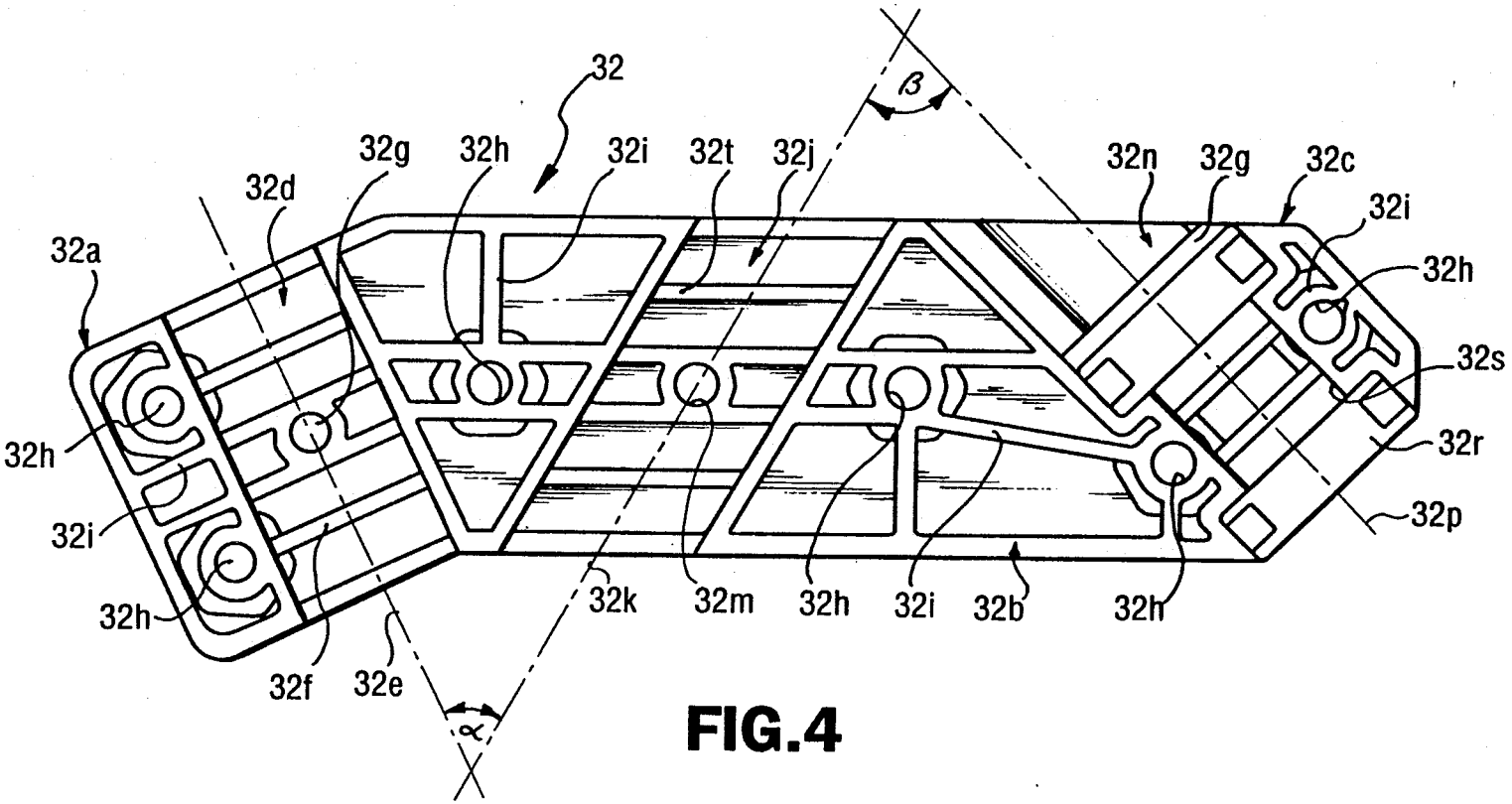
FIG. 4 is a side elevational view of the interior of one part or shell of the caster plate clamp shown in FIG. 1.
Figure 5:
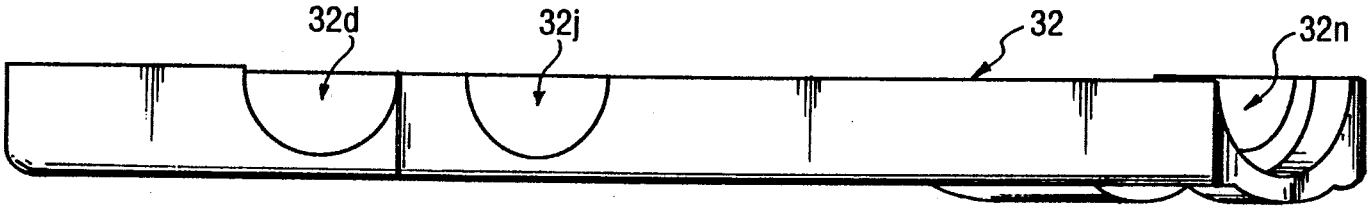
FIG. 5 is a plan view of the caster plate clamp part or shell shown in FIG. 4.

Referring to FIGS. 4 and 5, one presently preferred embodiment of the caster plate clamp 32 is illustrated in detail. Each caster plate clamp 32 consists of complimentary clamping shell pairs or mating halves which, when mated and joined together, form generally flat plate clamps as shown. In FIGS. 4 and 5, one-half of such a caster plate clamp 32 is illustrated, showing the interior surface, it being understood that the complimentary or mating half is substantially a mirror image construction and the description of one of these shell members or mating halves is equally applicable to the other mating half.

The caster plate clamp 32 is formed of generally three separate sections or portions, including end portions 32*a* and 32*c* and intermediate portion 32*b*. The end portion 32*a* is formed with an elongate semi-cylindrical region or opening 32*d* defining an axis 32*e*. The semi-circular region or opening is formed and reinforced by semi-cylindrical reinforcing ribs 32*f*. A through hole 32*g* extends through the wall of the region 32*d*, for reasons to be described hereafter. At the free end of the end portion 32*a* there are provided spaced through holes 32*h* which are reinforced with ribs or abutments 32*i* that have heights substantially corresponding to the thickness of the shells 32.

The intermediate region 32*b* of the shell 32 includes a generally semi-cylindrical region 32*j* which defines an axis 32*k*. The semi-cylindrical region 32*j* is defined and reinforced by semi-cylindrical ribs 32*t*. A through hole 32*m* is formed in the wall as shown, for reasons to be described hereinafter.

The region between the semi-cylindrical openings 32*d* and 32*j* is provided with a through hole 32*h* and reinforcing ribs or abutments 32*i* as shown.

The end region 32*c* of the shell 32 is provided with an axially stepped semi-cylindrical region 32*n* generally defined by large diameter semi-cylindrical regions 32*q* and 32*r* between which there is provided a smaller diameter semi-cylindrical region 32*s*. Through openings 32*h* are provided on the sides of the semi-cylindrical opening 32*n* and reinforced with ribs or abutments 32*i*. A through opening 32*h* is also provided between the semi-cylindrical openings 32*j* and 32*n*, again reinforced with ribs or abutments 32*i*.

The caster plate clamp may be molded or cast of any suitable material. In the present preferred embodiment, the clamp 32 is molded of a composite material. It has been found, for example, that such molded composite material may be a fiber-filled polyamide. Twenty percent carbon fiber-filled polyamides have been found to be suitable or satisfactory for this purpose. However, the specific composite or material used is not critical for purposes of the present invention.

The relative angles $\alpha$, $\beta$ formed by the axes 32*e*, 32*k* and 32*p* are selected to correspond with the general axes of the tubes which are received and clamped by the complimentary shells 32. Thus, the diameter of the semi-cylindrical region 32*d* is selected to generally correspond to the outer diameter of the seat tube 14, the diameter of the semi-cylindrical region 32*j* is selected to have a diameter substantially corresponding to the outer diameter of the bottom tube 16, while the diameter of the region 32*s* is selected to substantially correspond to the diameter of the upwardly extending shaft portion 28 of the caster assembly 22. The diameters of the regions 32*d* and 32*j* are selected so that when a pair of complimentary shells 32 are clamped about the corresponding the tubes are received in pressure fit relationship when tightened by fasteners F1. The regions 32*q* and 32*r* have diameters selected to correspond to bearings received within these regions, while the diameter of the intermediate region 32*s* is selected to permit substantially free rotation of the upwardly extending shaft portion 28 of the caster wheel 22 assembly therein when received therethrough. In the presently preferred embodiment, all the tubes that are used have the same outer diameters.

Figure 7:
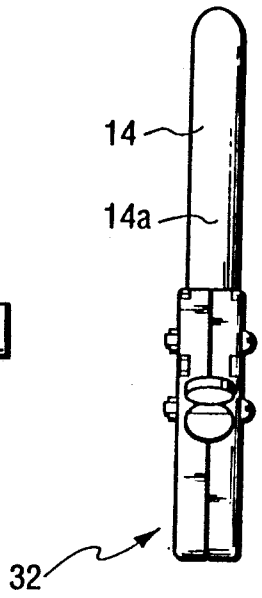
FIG. 7 is a front elevational view of the elements shown in FIG. 6.
Figure 6:
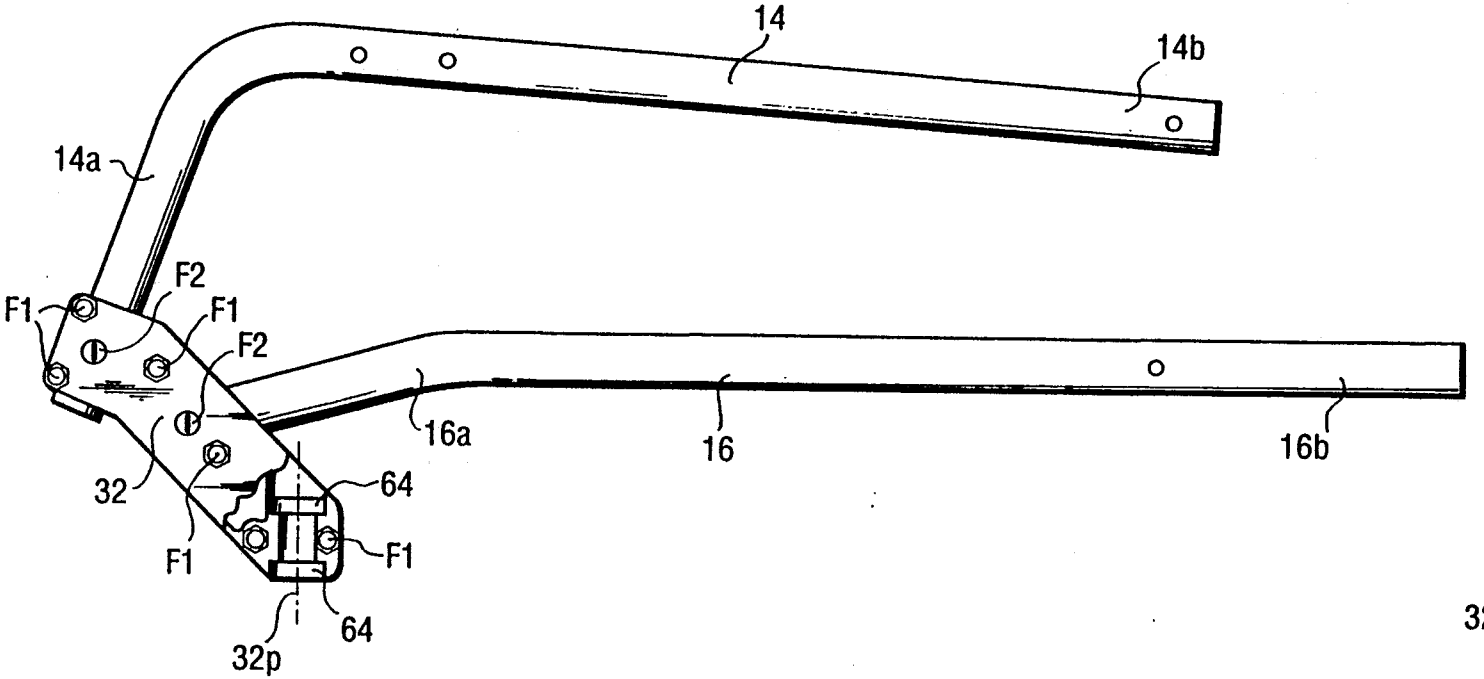
FIG. 6 is a side elevational view of the caster plate clamp shown in FIGS. 1, 4 and 5 clamping tubular elements of the wheelchair.

In FIGS. 6 and 7, initial assembly of the seat tube 14, bottom tube 16, and caster plate clamp 32 is shown. The downwardly extending portion 14*a* of the seat tube 14 is received within the cylindrical region formed by the complimentary semi-cylindrical regions 32*d*, and, similarly, the front most portion 16*a* of the bottom tube 16 is received within the complimentary semi-cylindrical regions 32*j* of the caster plate clamp 32. Appropriate fasteners F1 are extended through the through holes 32*h* to secure the complimentary shells together and bring them into press fit relationship against the tubes which they receive. Appropriate fasteners F2 extend through the holes 32*g*, 32*m* to secure the associated tubes. As will be noted in FIG. 6, when the seat and bottom tubes 14, 16 are arranged in their normal orientations, the axis 32*p* of the cylindrical region 32 that receives the upwardly extending shaft portion 28 is generally vertical. The bearings 64 are, like the tubes, secured in place by a press fit relationship.

Figure 8:
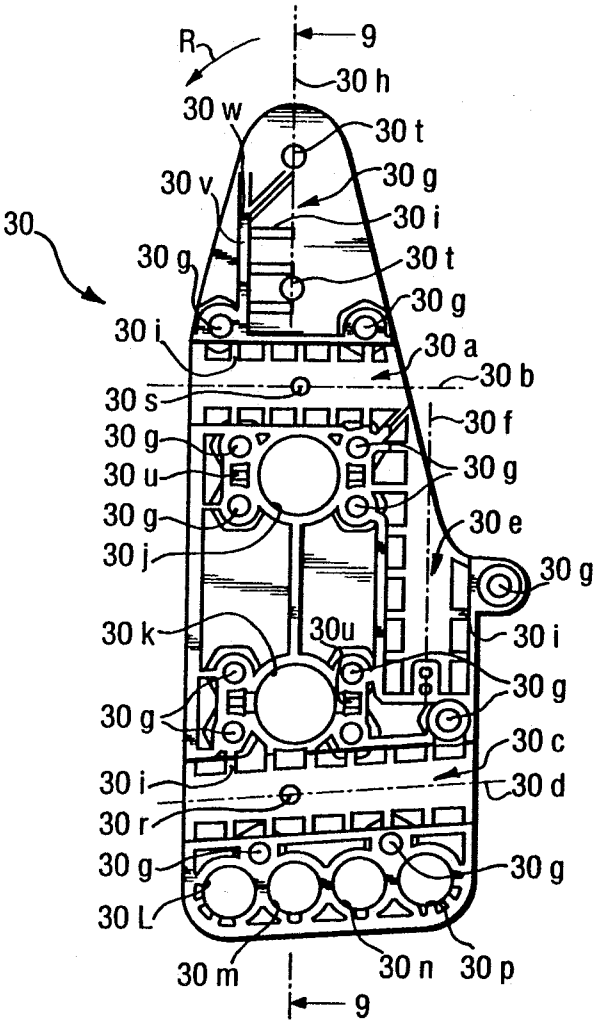
FIG. 8 is a side elevational view of the interior of one part or shell of the rear clamp assembly shown in FIG. 1.
Figure 9:
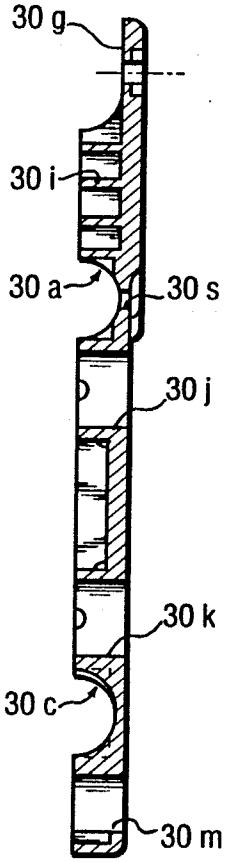
FIG. 9 is an end elevational view of the part or shell shown in FIG. 8.

Referring to FIGS. 8 and 9, one-half of a rear clamp assembly 30 is illustrated, in being understood that a complimentary, mirror image shell or mating half is provided that mates with the element shown to form the clamp 30. As with the caster plate clamp 32, the shells forming the clamp 30 may be molded or cast from the same materials as described previously.

At the upper end of the shell shown in FIG. 8, there is provided a semi-cylindrical region 30*a* defining a substantially horizontal axis 30*b*. Spaced below and near the bottom of the shell, there is defined a further semi-cylindrical region 30*c* also defining a substantially horizontal axis 30*d*. Extending substantially between the regions 30*a* and 30*b*, along the rearward end of the clamp 30 is a semi-cylindrical region 30*e* defining a substantially vertical axis 30*f* as shown. Extending above the region 30*a* is a region 30*g* which defines a substantially vertical axis 30*h*. The semi-cylindrical regions that have been described are formed and reinforced by ribs 30*i*. However, the semi-cylindrical region 30*g* has ribs 30*i* only on the side forwardly of the axis 30*h*, which ribs 30*i* are extended to a substantially vertical wall 30*v* substantially parallel to the axis 30*h* and having an upper end 30*w*, for reasons to be discussed below.

Just below the region 30*a* is a through hole 30*j*. Just above the region 30*c* is a through hole 30*k*, the diameters of the holes 30*j* and 30*k* substantially corresponding to the diameters of the cross or transverse tubes 46, 48 as will be more fully discussed below. Spaced from the forward to the rear ends of the shell and below the region 30*c*, there are provided four through holes 30L, 30*m*, 30*n* and 30*p*, which are dimensioned to correspond to the outer diameter of the shaft (not shown) which supports the rear wheels 56 of the wheelchair. As with the caster plate clamp 32, reinforced through holes 30*q* are provided on both sides of the semi-cylindrical regions 30*a*, 30*c* and 30*e* to allow the clamps to apply clamping pressures on the tubes received within these regions. The lower horizontal region 30*c* is provided with a blind hole 30*r*, while the upper horizontal region 30*a* is provided with a similar blind hole 30*s*. The upper vertical region 30*c* is similarly provided with through holes 30*t*.

Figure 11:
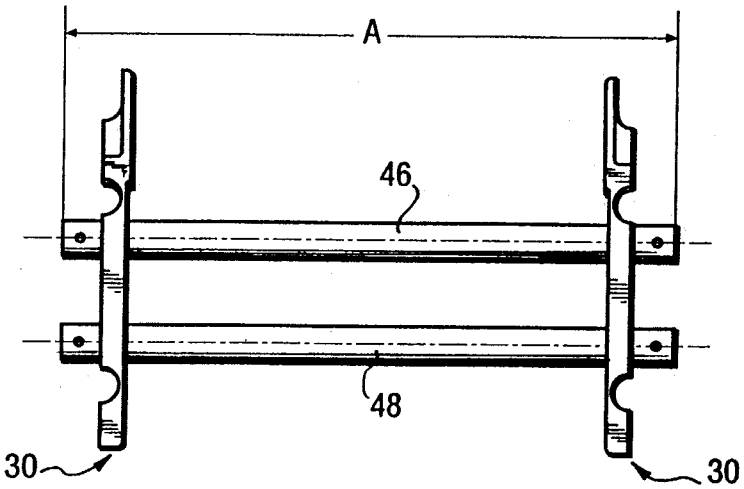
FIG. 11 is a front elevational view of rear clamp parts or shells shown in FIGS. 8 and 9, illustrating how the cross tubes are received in the rear clamps.
Figure 10:
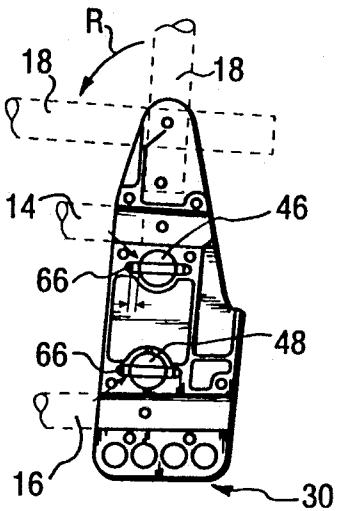
FIG. 10 is similar to FIG. 8, but showing how tubular members are received and positioned in the rear clamp assembly prior to joining mating clamp parts or shells to rigidly secure same by pressure relationship.

In FIG. 10, there is illustrated the manner in which the seat and bottom tubes 14, 16, 18 respectively, are received within the substantially horizontal cylindrical regions 30*a*, 30*c* and 30*g*. Referring also to FIG. 11, there is shown the manner in which the cross tubes 46, 48 are received within the openings 30*j* and 30*k* and locked or secured in place by means of cross pins 66 inserted into transverse holes in the tubes after they have been extended or passed through the apertures in the inwardly positioned shells. Referring to FIG. 8, the shell is advantageously provided with recesses 30*u* which provide a locking seat for the cross tube pins 66. It will be appreciated that once the pins 66 have been inserted into the cross tubes 46, 48 and the clamp shells or halves have been moved outwardly to engage these pins, the lengths of the cross tubes 46, 48 effectively define the width of the wheelchair.

Figure 12:
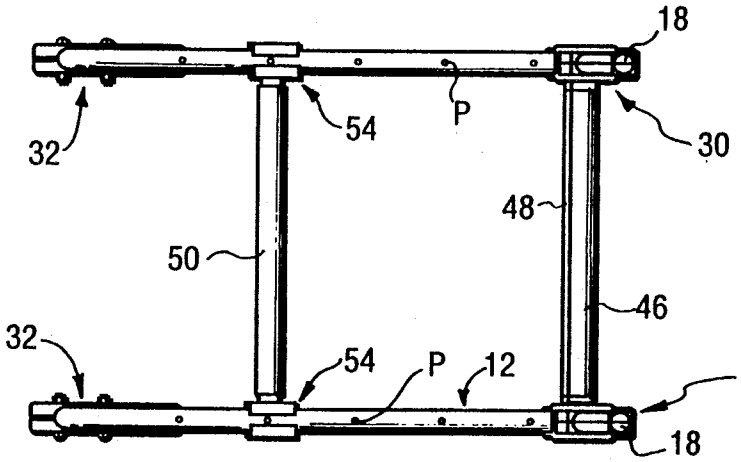
FIG. 12 is a top plan view of the side frame assemblies and showing how the cross-tubes are secured by the clamps.
Figure 17:
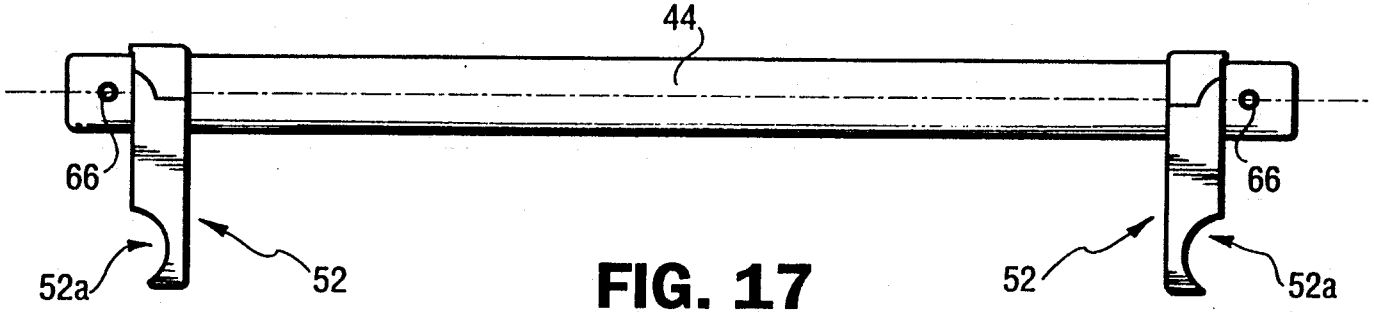
FIG. 17 is a front elevational view of a cross bar cooperating with the cross tube clamp shown in FIG. 16.
Figure 16:
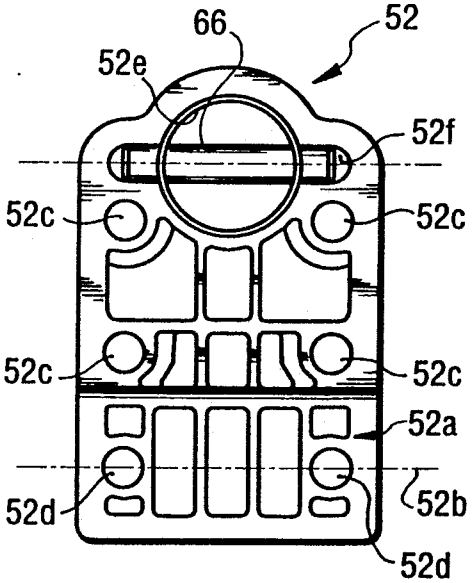
FIG. 16 is a side elevational view of the inside of one part or shell of a cross tube clamp shown, for example, in FIG. 1.

In FIG. 12, the opposing side frame assemblies 12 are illustrated, with the cross tubes 46 and 48 in place, and also showing further cross tube 50 extending between the seat tubes 14. The cross tube 50 that extend between the seat tubes and as the cross tube 44 that extends between the backrest tubes 18 are secured in place by means of clamps or retainers 52 and 54 as aforementioned. The details of such clamps or retainers are illustrated in FIGS. 16 and 17. Since both retainers 52, 54 can be the same, only retainer 52 will be described. Each half or complimentary shell of the retainer 52 includes a semi-cylindrical region 52*a* which defines an axis 52*b* and fastening through holes 52*c* to the sides of the region 52*a*. Fastening through holes 52*d* are provided within the region 52*a* along the axis 52*b*. A blind hole 52*e* is provided which has a diameter substantially corresponding to the diameter of the cross tube 44 and an elongate indentation or recess 52*f* is provided for receiving a cross pin 66. In FIG. 17, the cross tube 44 is shown with its free ends extending through the innermost shells of the retainers 52 with pins 66 extending through transverse holes provided in the cross tube. When used to secure the cross tube 44, the backrest tubes 18 are received within the cylindrical regions 52*a*, while when used to support the cross tube 50, the regions 52*a* receive the seat rest tubes 14.

Figure 15:
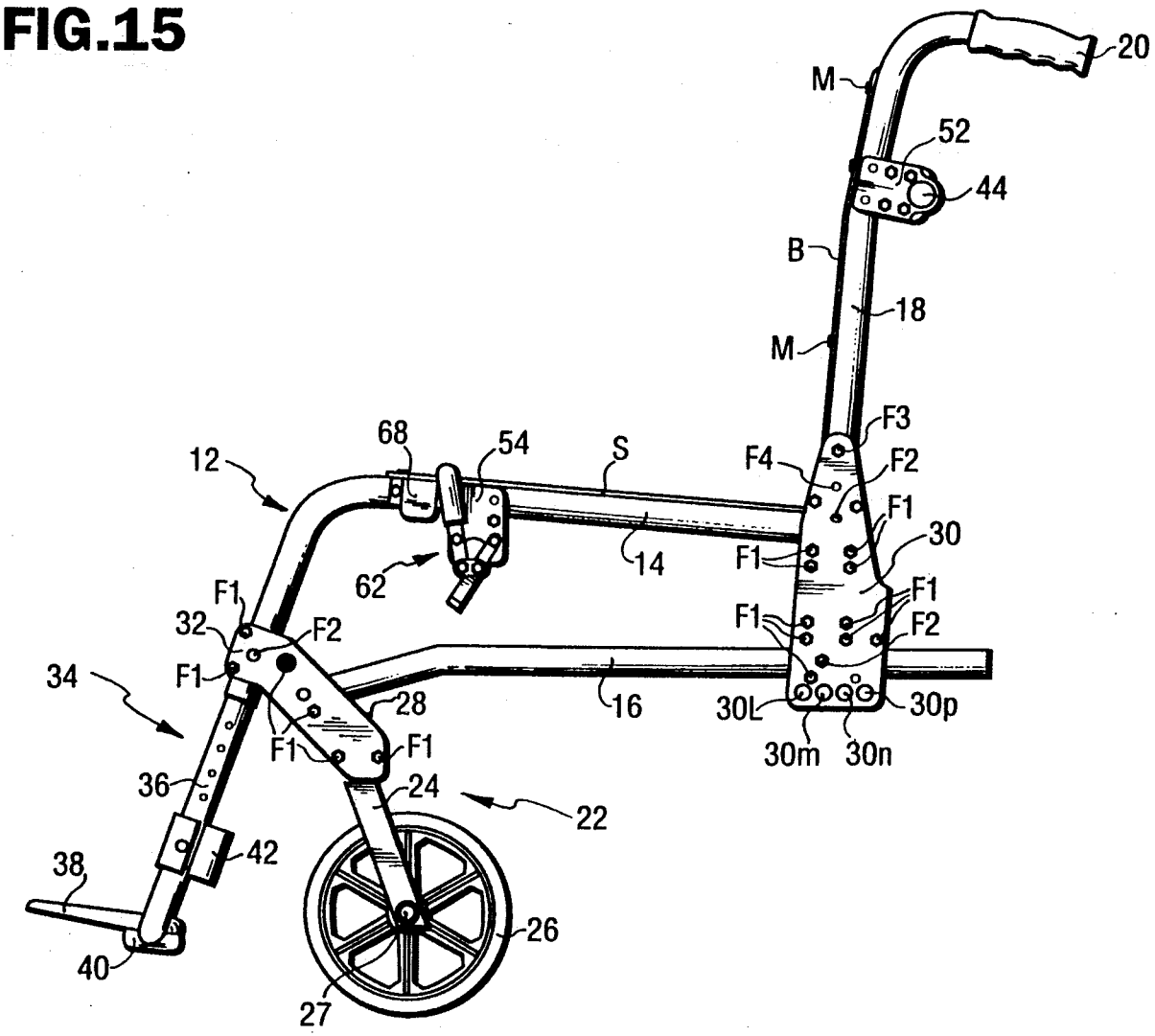
FIG. 15 is similar to FIG. 6, but showing the backrest assembly of FIGS. 13 and 14 secured to the rear clamps.

In FIG. 15, the seat and bottom tubes 14, 16 respectively, are shown clamped within the rear clamp assemblies 30 as well as in the caster plate clamps 32. The rear clamp assemblies are also shown to receive and support the vertical backrest tubes 18 within the regions 30*g* of the clamps 30. Suitable fasteners F1, such as screws and locknuts are used through the appropriate through holes to clamp mating shells of the various clamps to each other and fasteners F2 to secure the various tubes to the associated clamps. A seat covering S and back covering B are attached to seat tubes 14 and backrest tubes 18, respectively, by any conventional means, such as metal screws M received in pre-drilled pilot holes P. A fastener F3, which may be similar to the fasteners F2, serves a pivot pin for the backrest tubes 18, while the fastener F4 is advantageously selected to be easily removable, such as a removable pin. When fasteners, F3 and F4 are in place, as in FIG. 15, the backrests 18 are maintained in a generally vertical direction. However, when the fastener F4 is removed, this releases the backrest tube 18, permitting it to pivot or rotate in a counterclockwise direction (direction R in FIG. 10) until it is substantially horizontal and abuts against the upper end 30*w* (FIG. 8) of the vertical wall 30*v*. This allows the backrest to be folded forwardly or collapsed when the wheelchair is to be stored or transported.

Figure 18:
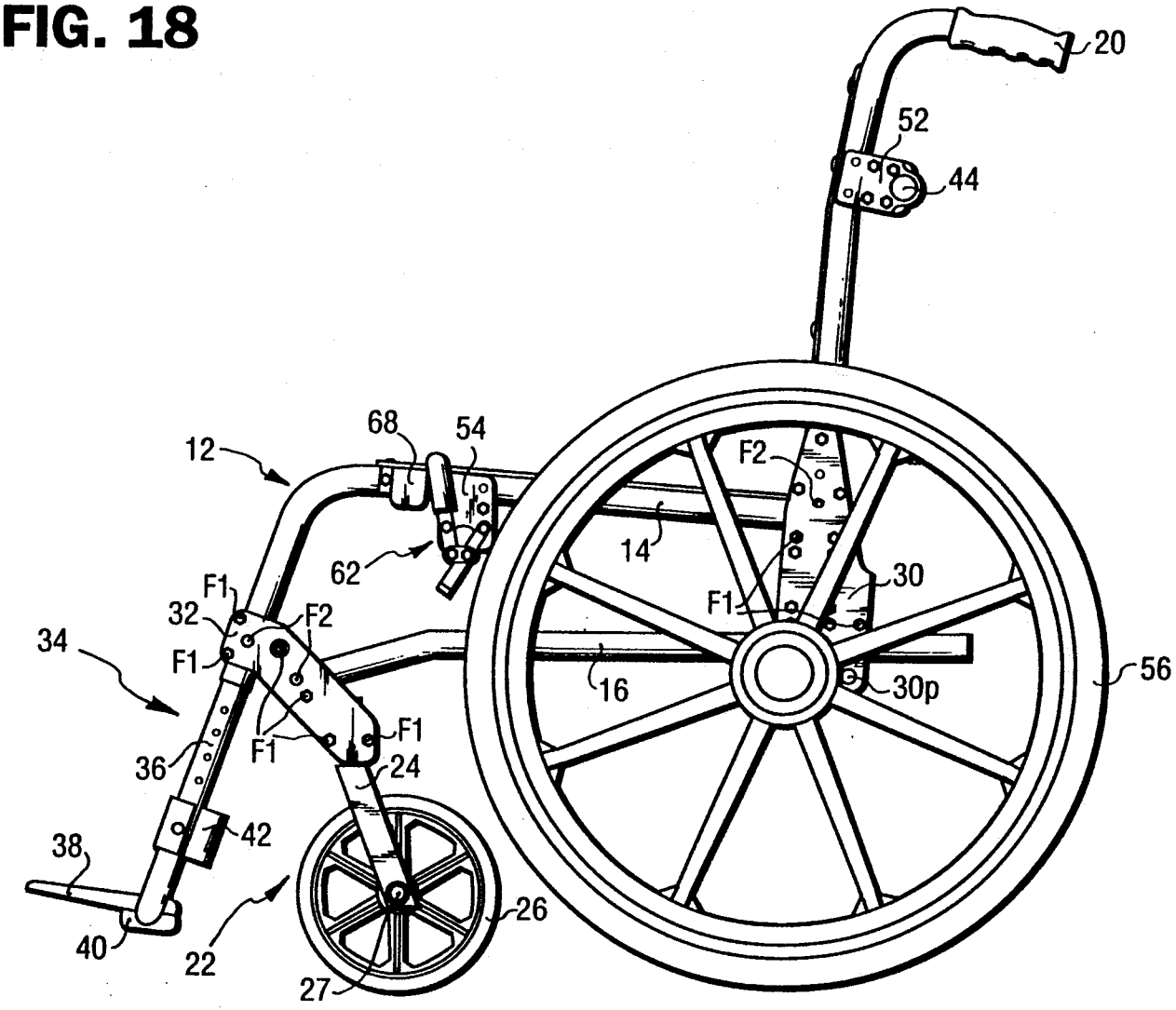
FIG. 18 is similar to FIG. 15 but further illustrating the rear wheel mounted on the rear clamp.

In FIG. 18, the rear wheel has been mounted, by mounting it on a shaft which extends through corresponding through holes 30L, 30*m*, 30*n* or 30*p* of the rear clamp assembly. The specific through hole selected is a function of the desired center of gravity position. The more rearwardly that the rear wheel shaft is moved, the more stable the chair, although less maneuverable. Greater maneuverability is achieved by moving the rear wheel forwardly, although this renders the chair somewhat less stable.

Figure 19:
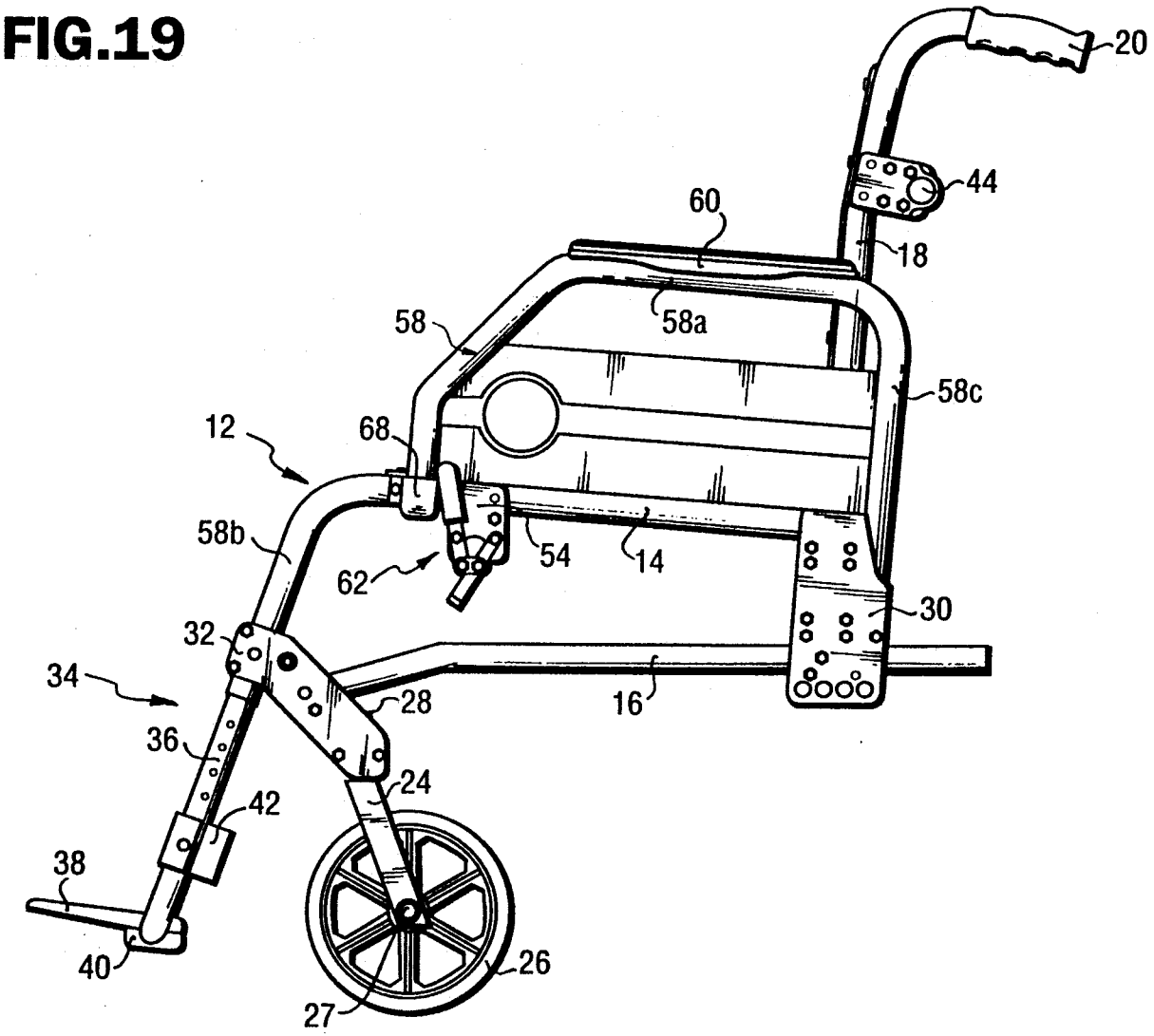
FIG. 19 is similar to FIG. 18, with the rear wheel removed, but showing the manner in which the side armrest sub-assembly is mounted on the seat tube.

Mounted on the seat tube 14, just forwardly of the retainer, the 54 is a receptacle 68 which is provided with a cylindrical opening only at the top for receiving the lower front end 58*b* of the armrest tube 58. As suggested in FIG. 19, the armrest tube 58 is selectively removable and repositionable on the armchair by withdrawing the downwardly extending ends 58*b*, 58*c* of the armrest tube from the receptacle 68, at the front end, and from the vertical cylindrical region 30*e* of the backrest assembly 30, respectively. Aside from the armrest tube 58, however, all of the other tubular members are rigidly joined to each other by means of the caster plate clamps 32, the rear clamp assemblies 30 and the cross tube clamps or retainers 52, 54.

The various tubular members which have been described can be formed of aluminum, stainless steel, titanium or any other material. The composites or plastic material selected for the various clamps require very high tensile strengths so that the materials selected are tough and do not exhibit "creep" over extended periods of time. The polymer composite brackets are each constructed of two pieces or mating shells to facilitate inexpensive and quick assembly in this assembly.

In fatigue tests, the construction in accordance with the present invention exhibited very good stability and rigidity over long periods of time when riding over small obstacles such as door thresholds and the like, riding over uneven road surfaces that imparted twisting moments to the frame. Dynamic testing was carried out according to the ISO test procedures and test were terminated at 240,000 cycles, although no class three failures were observed in the frame structure. The overall frame was judged to be very durable and has been found to maintain wheel alignment under the most severe use. The polymer composite front caster brackets withstood the fatigue tests extremely well and should function throughout the life of the wheelchair.

By using clamps of the type described made of high tensile strength materials, rigid frame wheelchairs are now possible which do not require or rely on welded joints as in the prior art rigid frame wheelchairs. By dispensing with the welds, the strengths of the wheelchairs are enhanced by avoiding the metal fatigue due to crystallization/oxidation in the heat-effected zones next to the welds. This almost totally avoids the safety hazards of chair collapse due to weakening of welded regions. Also, because no welds are used, the wheelchairs can be mass-produced and assembled by almost anyone. This makes the rigid frame wheelchairs of the present invention much less expensive to manufacture and less costly to the end purchaser. Repairs to the subject wheelchairs are also relatively simple and inexpensive and, unlike with the prior art wheelchairs, can be done in the field since no welding or other special equipment is necessary. Disassembly for storage or transport is also facilitated. Also, since the tubes can be rigidly assembled without welds, the subject rigid frame wheelchair also eliminates various manufacturing operations, such as polishing, grinding, electrochemical plating, etc., all of which are hazardous to workers and the environment.

While particular embodiments of this invention have been shown and described, it will be obvious to those skilled in the art that various changes and modifications will be made therein without the parting from the spirit and scope of the invention. Therefore, it is intended that the appendant claims cover all such changes and modifications which fall within the true spirit and scope of the invention.

I claim:

1. A wheelchair comprising:

(a) a pair of like side frame assemblies spaced from each other and each including a generally horizontal seat tube; a generally horizontal bottom tube below said seat tube, each of said seat and bottom tubes having front and rear ends; and a generally vertical back rest tube having a lower end proximate to said rear ends of said seat and bottom tubes and an upper end extending upwardly of said seat tube and forming hand grips;

(b) a caster assembly for each side frame assembly carrying a caster wheel and having a generally upwardly extending shaft portion;

(c) first clamping means for each of said side frame assemblies for rigidly clamping respective rear ends of said seat and bottom tubes and said lower end of said back rest tubes;

(d) second clamping means for each of said side frame assemblies for rigidly clamping respective front ends of said seat and bottom tubes and caster assembly tube portion;

(e) footrest support means secured to said seat tube;

(f) a plurality of traverse tube means having ends and extending between said side frame assemblies and having lengths substantially corresponding to a width of the wheelchair;

(g) third clamping means for rigidly connecting the ends of each transverse tube means to a respective side frame assembly;

(h) a wheel axle extending through each of said second clamping means; and (i) rear wheels mounted on said rear axle, said first, second and third clamping means being formed of a molded composite material.

2. A wheelchair as defined in claim 1, wherein said molded composite material comprises a fibre-filled polyamide.

3. A wheelchair as defined in claim 2, wherein said material comprises a 20% carbon fibre-filled polyamide.

4. A wheelchair as defined in claim 1, wherein each of said clamping means comprises a channel dimensioned to receive a respective tube member to be clamped in press-fit relationship.

5. A wheelchair as defined in claim 4, wherein each clamping means is provided with re-enforcing ribs to strengthen said clamping means.

6. A wheelchair as defined in claim 1, wherein a center of gravity adjusting means comprises a series of wheel axle receiving holes in each said first clamping means, said holes in each first clamping means generally being arranged along a direction extending forwardly and rearwardly of the wheelchair.

7. A wheelchair as defined in claim 1, further comprising receptacle means proximate to the front end of each seat tube and in said first clamping means; and armrest tubes associated with each of said side frame assemblies and having free ends removably receivable within said receptacle means.

8. A wheelchair as defined in claim 1, wherein said footrest support means comprises a generally U-shaped footrest tube having spaced upwardly extending tube portions connected to said each of said seat tubes and a generally horizontal tube portion; and further comprising a foot plate mounted on said horizontal tube portion.

9. A wheelchair as defined in claim 8, further comprising fourth clamping means for clamping said footplate to said horizontal tube portion.

10. A wheelchair as defined in claim 8, wherein said upwardly extending tube portions are telescopically connected to each of said seat tubes to permit height adjustments of said foot plate relative to each of said seat tube.

11. A wheelchair as defined in claim 9, wherein said fourth clamping means is formed of a fibre-filled molded composite material.

12. A wheelchair as defined in claim 11, wherein said material comprises a 20% carbon-filed polyamide.

13. A wheelchair as defined in claim 1, wherein said tubes all have the same diameter.

14. A wheelchair as defined in claim 1, wherein said tubes are formed of steel.

15. A wheelchair as defined in claim 1, wherein said tubes are formed of aluminum.

16. A wheelchair as defined in claim 1, wherein said tubes are formed of titanium.

17. A wheelchair as defined in claim 1, further comprising wheel locks on each of said seat tube.

18. A wheelchair as defined in claim 1, further comprising a center of gravity adjusting means for selectively moving the position of said wheel axle forwardly or and rearwardly to shift weight to said rear wheels.

* * * * *